US007401656B2

(12) United States Patent
Wood et al.

(10) Patent No.: US 7,401,656 B2
(45) Date of Patent: Jul. 22, 2008

(54) MOBILE DRILLING RIG WITH DUAL CARRIERS

(75) Inventors: Thomas D. Wood, Calgary (CA); Richard D. Havinga, Okotoks (CA)

(73) Assignee: Xtreme Coil Drilling Corp., Calgary (CA)

( * ) Notice: Subject to any disclaimer, the term of this patent is extended or adjusted under 35 U.S.C. 154(b) by 237 days.

(21) Appl. No.: 11/375,927

(22) Filed: Mar. 15, 2006

(65) Prior Publication Data

US 2007/0125552 A1 Jun. 7, 2007

Related U.S. Application Data

(63) Continuation-in-part of application No. 11/294,278, filed on Dec. 5, 2005, now Pat. No. 7,383,890.

(51) Int. Cl.
*E21B 19/22* (2006.01)
*E21B 19/08* (2006.01)

(52) U.S. Cl. ..... 166/384; 166/77.3; 166/85.5

(58) Field of Classification Search ..... None
See application file for complete search history.

(56) References Cited

U.S. PATENT DOCUMENTS 6,932,553 B1 * 8/2005 Roodenburg et al. ..... 414/22.51
6,973,979 B2 * 12/2005 Carriere et al. ..... 175/203
2003/0098150 A1 * 5/2003 Andreychuk ..... 166/77.2

* cited by examiner

*Primary Examiner*—Zakiya W. Bates
(74) *Attorney, Agent, or Firm*—Browning Bushman P.C.

(57) ABSTRACT

A rig (10) for selectively inserting coiled tubing or threaded tubulars into a well includes a mast (14) extending upward from a mast carrier (12), and a coiled tubing injector (16) and a coiled tubing reel (26) supported on a coiled tubing carrier (28) separate from the mast carrier. The mast (14) may be pivotal on the mast carrier to attach the coiled tubing injector 16 to the mast while the injector is supported on the coiled tubing carrier.

23 Claims, 7 Drawing Sheets

MOBILE DRILLING RIG WITH DUAL CARRIERS

CROSS REFERENCE TO RELATED APPLICATIONS

This application is a continuation-in-part of U.S. patent application Ser. No. 11/294,278, filed Dec. 5, 2005, now U.S. Pat. No. 7,383,890 for a UNIVERSAL RIG WITH VERTICAL STAND FOR TUBULARS, which is incorporated herein in its entirety for all purposes.

FIELD OF THE INVENTION

The present invention relates to a rig for selectively inserting either coiled tubing or a threaded tubular through the rig floor and into the well. More particularly, the invention relates to a rig with a mast supporting both a coiled tubing injector and a top drive. The rig allows tubular joints to be more efficiently run into and out of the well when utilizing the top drive, and also may enhance the efficiency of coiled tubing operations. The mast extends upward from a substructure which is separate from a coiled tubing carrier for transporting the coiled tubing reel and the coiled tubing injector.

BACKGROUND OF THE INVENTION

Various styles of rigs have been proposed for utilizing both coiled tubing and threaded tubulars to be selectively inserted through the rig floor and into the well. Rigs conventionally include a mast extending upward from a rig base when in an operative position. Rigs sometimes referred to as universal rigs include both a coiled tubing injector supported on the mast to insert coiled tubing into the well, and a top drive movable along an axis of the mast when in the operative position to insert a threaded tubular into the well.

Rigs with coiled tubing injectors have traditionally relied primarily upon the use of the coiled tubing to conduct downhole operations. Coiled tubing is thus conventionally used to suspend a downhole motor in the well, with fluid pumped through the coiled tubing to drive the downhole motor and drill the well. Other operations may also be conducted with coiled tubing in a manner more efficient than if conducted with threaded tubulars. Top drives have also been provided on the mast of universal rigs for inserting a threaded tubular into a well, although typically top drives have been used to threadably connect sections of a bottom hole assembly or to run surface casing in the well, and generally have not been used to drill substantial portions of the well. Accordingly, when a plurality of tubular joints are run in or out of the well utilizing the top drive, the tubular joints are threadably connected or disconnected, and are pulled up or laid down on the rig floor through the V-door of the rig. This operation takes a considerable amount of time and is thus costly.

One of the problems with rigs adapted for conducting both coiled tubing and conventional threaded tubular operations involves both the practical and government-imposed limitations on the weight for a trailer or other carrier being transported along public roadways to a rig site. Depending on the size of the drilling rig, the coiled tubing reel, the coiled tubing injector, the top drive, and the mast may all be supported on a single carrier. In other embodiments, the weight of these components does not allow for a sufficient amount of coiled tubing to be placed on the same carrier with the mast, the top drive, and the injector. Accordingly, an injector may be transported with the mast on a mast carrier separate from the coiled tubing reel on a coiled tubing carrier, in which case the end of the coiled tubing must be threaded through the injector before the injector becomes operational at the well site. Additional difficulties are encountered to safely release the coiled tubing from the injector after the coiled tubing operation is complete. In other applications, the mast is transported to the well site separate from the substructure which includes a work platform, and the mast is raised to extend upward from the work platform. Another carrier may be used to transport the coiled tubing reel to the well site. These difficulties have decreased the efficiency of coiled tubing units, and may be create safety problems.

The disadvantages of the prior art are overcome by the present invention, and an improved rig is hereinafter disclosed for selectively inserting coiled tubing or threaded tubulars into a well.

SUMMARY OF THE INVENTION

In one embodiment, a rig for selectively inserting coiled tubing or threaded tubulars through a rig floor and into a well comprises a mast extending upward from a rig base when in the operative position, a coiled tubing injector supported on the mast when in the operative position to insert the coiled tubing into the well, and a top drive movable along an axis of the mast when in operative position to insert the threaded tubulars into the well. A rack or support may be secured to the mast for receiving a plurality of substantially threaded tubular joints therein when the mast is in the operative position, such that the tubular joints may be moved between the top drive and the rack or support when running threaded tubulars into or out of the well. In one embodiment, a coiled tubing carrier may be provided separate from the mast carrier, with the coiled tubing carrier supporting both the coiled tubing injector and the coiled tubing reel during transport. Since both the injector and the reel are on the same carrier during transport, the coiled tubing need not be separated from the injector when moving from one well site to another well site.

In another embodiment, the rig includes a mast, a coiled tubing injector and a top drive, as discussed above. The coiled tubing reel supplying coiled tubing to the coiled tubing injector is spaced opposite the rack or support with respect to the mast when in the operative position. The rack supports a plurality of threadably connected and vertically spaced tubular joints within the support, so that, for example, approximately 60 feet or 90 feet of threadably connected tubulars may each be supported on the rack or support. In one embodiment, a coiled tubing injector and coiled tubing reel may be provided on a coiled tubing carrier structurally separate from the mast carrier which transports the mast.

According to one embodiment of the method of the invention, a mast is utilized extending upward from a rig base when in the operative position, and a coiled tubing injector is supported on the mast when in the operative position. A top drive is moved along the axis of the mast when in an operative position to insert the threaded tubulars into the well. The method includes securing a rack or support to the mast for receiving a plurality of substantially vertical threaded tubular joints therein when the mast is in an operative position, selectively passing coiled tubing through the coiled tubing injector and into the well, and selectively moving the tubular joints between the top drive and the support when running threaded tubulars into and out of the well.

Further features and advantages of the present invention will become apparent from the following detailed description, wherein reference is made to the figures in the accompanying drawings.

DETAILED DESCRIPTION OF PREFERRED EMBODIMENTS

Figure 1:
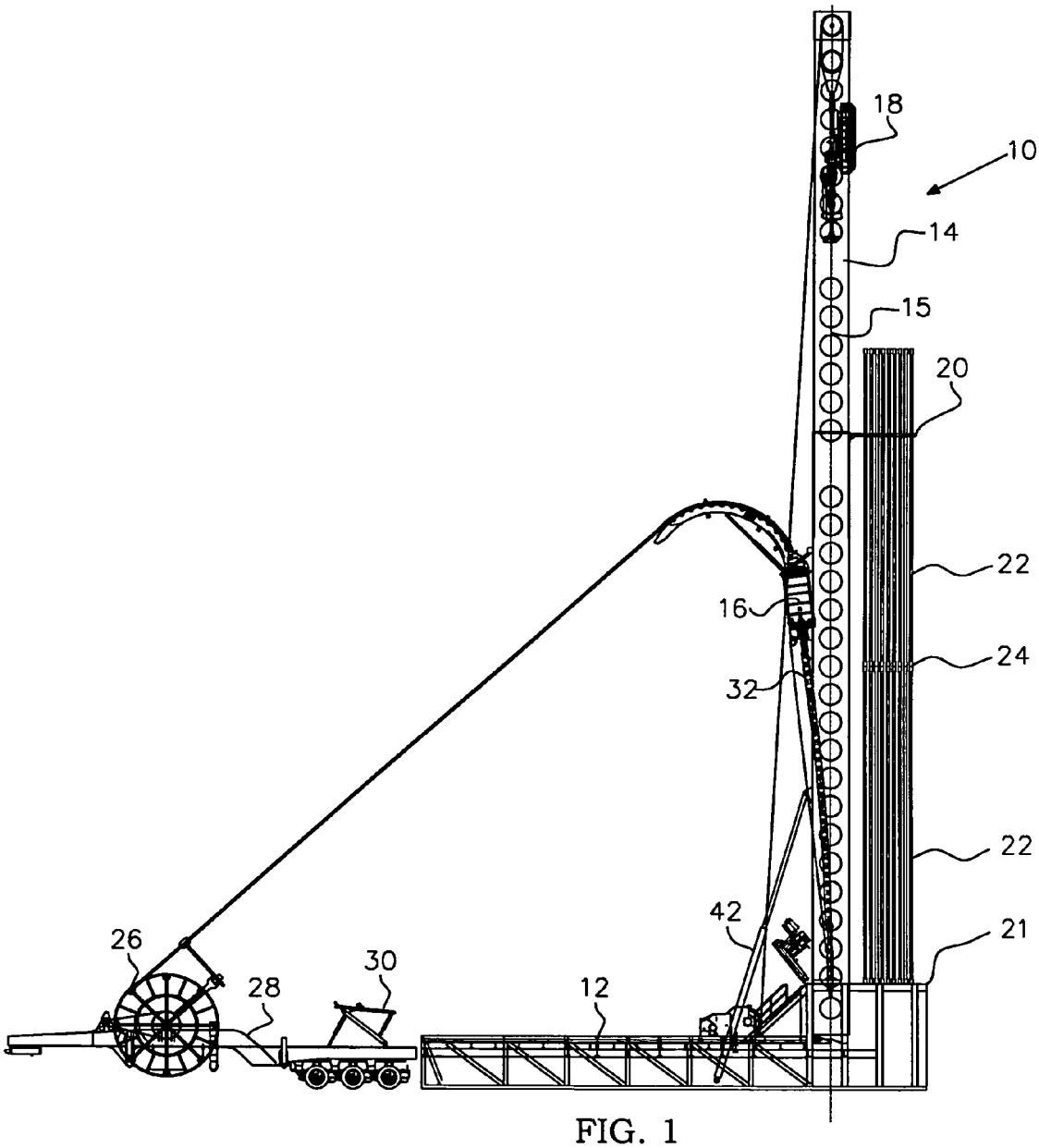
FIG. 1 illustrates a rig for selectively inserting coiled tubing or threaded tubulars into a well, with the injector including a lubricator axis offset from the mast, and a rack or support.

Referring to FIG. 1, a rig 10 is shown having a rig base or substructure 12 and a mast 14 extending generally upward from the rig base when in an operative position to insert either coiled tubing or threaded tubulars into the well. Mast 14 supports a coiled tubing injector 16 when in an operative position to insert the coiled tubing in to the well, and a top drive 18 movable along an axis 15 of the mast when in an operative position to insert the threaded tubulars into a well. FIG. 1 illustrates a tubular support or rack 20 secured to the mast 14 for receiving a plurality of substantially vertical threaded tubular joints 22 therein when the mast is in the operative position, thereby allowing the threaded tubular joints to be moved between the top drive 18 and the support 20 when running threaded tubulars into or out of the well. Each tubular joint 22 in one embodiment may consist of drill pipe, with support 20 containing a plurality of drill pipe joints threadably connected with a pin and box connection 24, so that the support may receive three vertically stacked joints each approximately 30 feet in length, such that the combined joints within the stand 20 are each approximately 90 feet in length. For the depicted embodiment, two vertically stacked 45 foot joints have a length of approximately 90 feet. Alternatively, the joints 22 may comprise drill collars which may also be connected to form tubular lengths of 45 feet or more, so that the connected drill collars can be moved between the end of the coiled tubing and the support 20 when running coiled tubing into or out of the well. The support 20 may thus contain various types of tubulars, including drill pipe, tubulars comprising work strings or production strings, drill collars, or sections of a bottom hole assembly. Further details regarding a suitable support for connection to a mast 14 are disclosed in U.S. Pat. No. 4,077,525.

Referring still to FIG. 1, the coiled tubing injector 16 is shown with a lubricator 32 having its upper end connected to a lower end of the injector, with a lubricator 32 having a housing with interior rollers such that the lubricator axis, and the axis of the coiled tubing passing through the lubricator, allows the tubing to pass through the injector axis spaced from and inclined relative to the central axis 15 of the mast, although the coiled tubing which exits the lubricator may be substantially aligned with the axis of the well. The lubricator may be connected to the injector when the injector is secured to the mast in its substantially vertical position, or the lubricator and the injector could be raised by the mast as an assembly when the mast is lowered to pick up the injector and the lubricator from trailer 28, which includes a coiled tubing reel 29 and a powered platform 30 for raising the injector for connection to the mast.

Figure 2:
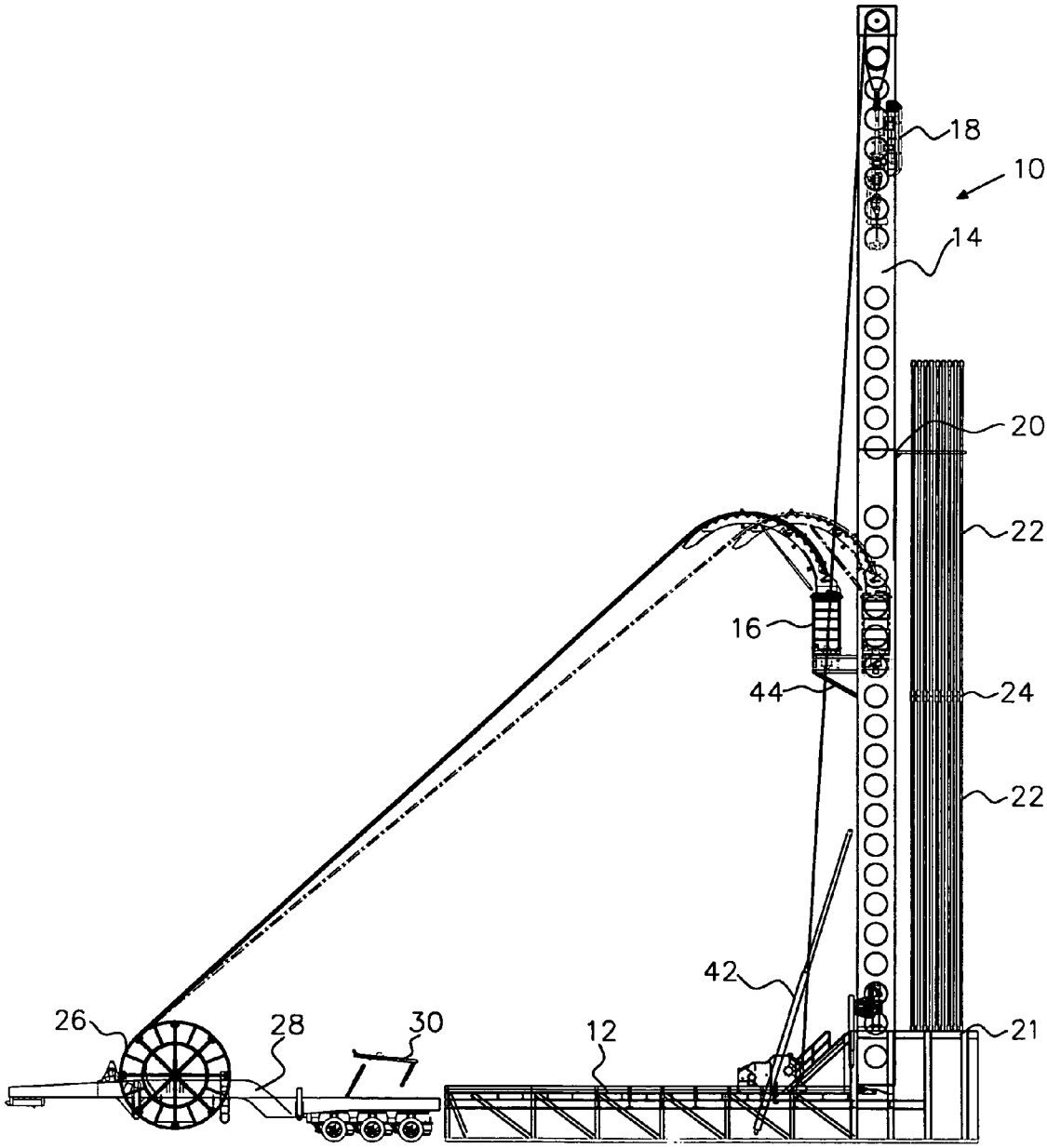
FIG. 2 discloses a rig wherein the coiled tubing injector is laterally movable relative to the mast from an inoperative position to an operative position. The rack or support is secured to the mast for receiving a plurality of vertically threaded tubular joints therein.

Referring to FIG. 2, the rig 10 includes a rig base 12, a mast 14, and a top drive 18 as previously described. In this and other embodiments, one or more cylinders 42 may be used for lowering the mast from a substantially upright position to a substantially horizontal position for travel. In this embodiment, the injector 16 is laterally movable with respect to the mast on injector support 44, so that when the injector is in the left position as shown in FIG. 2, the top drive may be used for running threaded tubulars into and out of the well. When the injector is in the right-side position as shown in FIG. 2, the injector may be used for running coiled tubing into and out of the well. When the injector is in the left side position, the top drive 18 may be raised to a position above the top of the tubulars 22, then the top drive connected to the tubular to run the joined tubular joints into the well.

Figure 3:
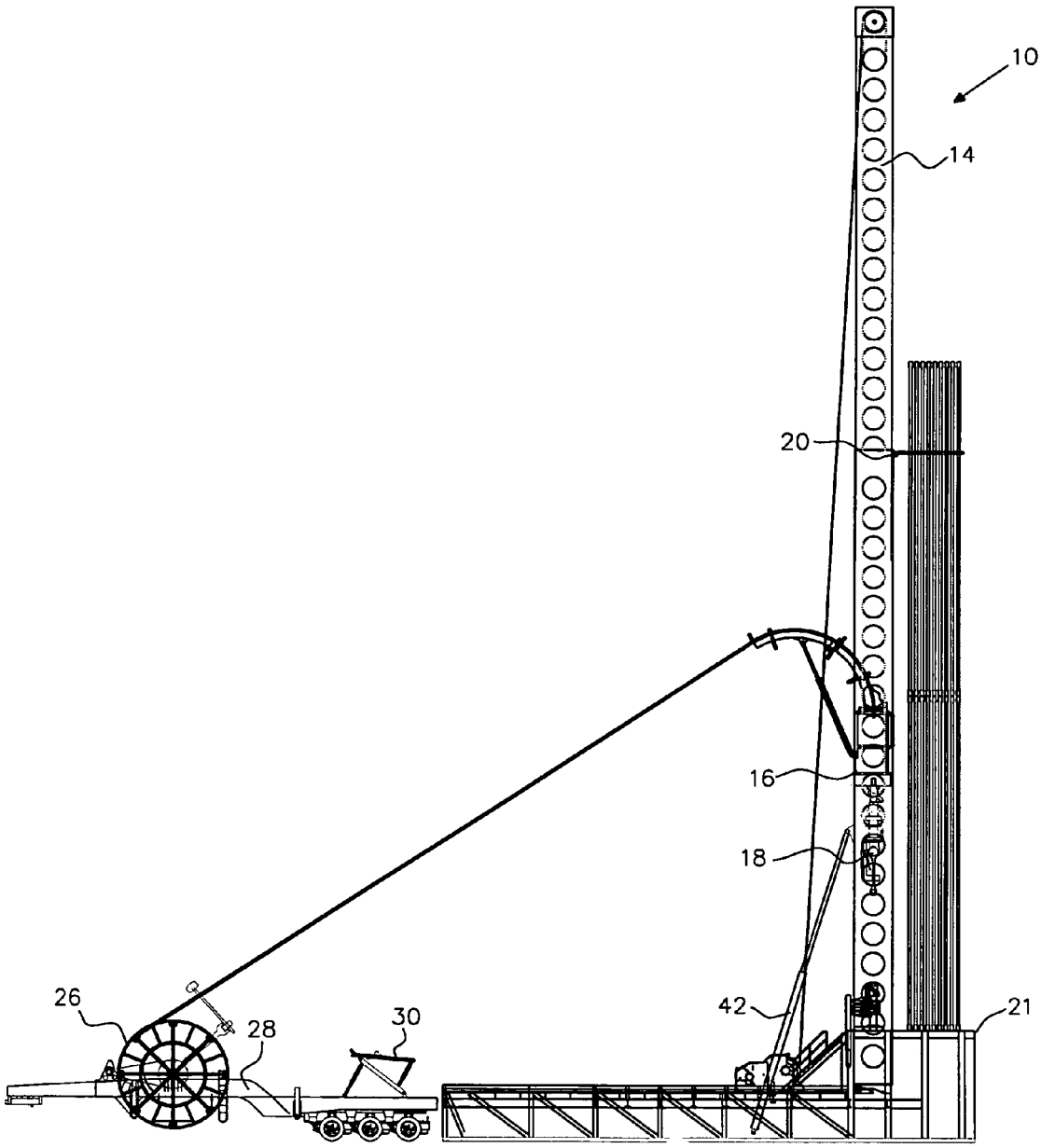
FIG. 3 discloses a rig wherein the coiled tubing injector is supported on the mast above the top drive, such that coiled tubing passes through the injector and through the top drive into the well. A rack or support is secured to the mast for receiving vertically threaded tubular joints therein.

Referring to FIG. 3, the injector 16 is provided above the top drive 18, since in this embodiment the coiled tubing passes through the injector and in through the top drive before passing into the well. When running threaded tubular operations, the injector 16 is raised to a position above the upper end of the tubulars in the rack or support 20, so that the top drive 18 can be lowered to engage the top of the tubular.

Figure 4:
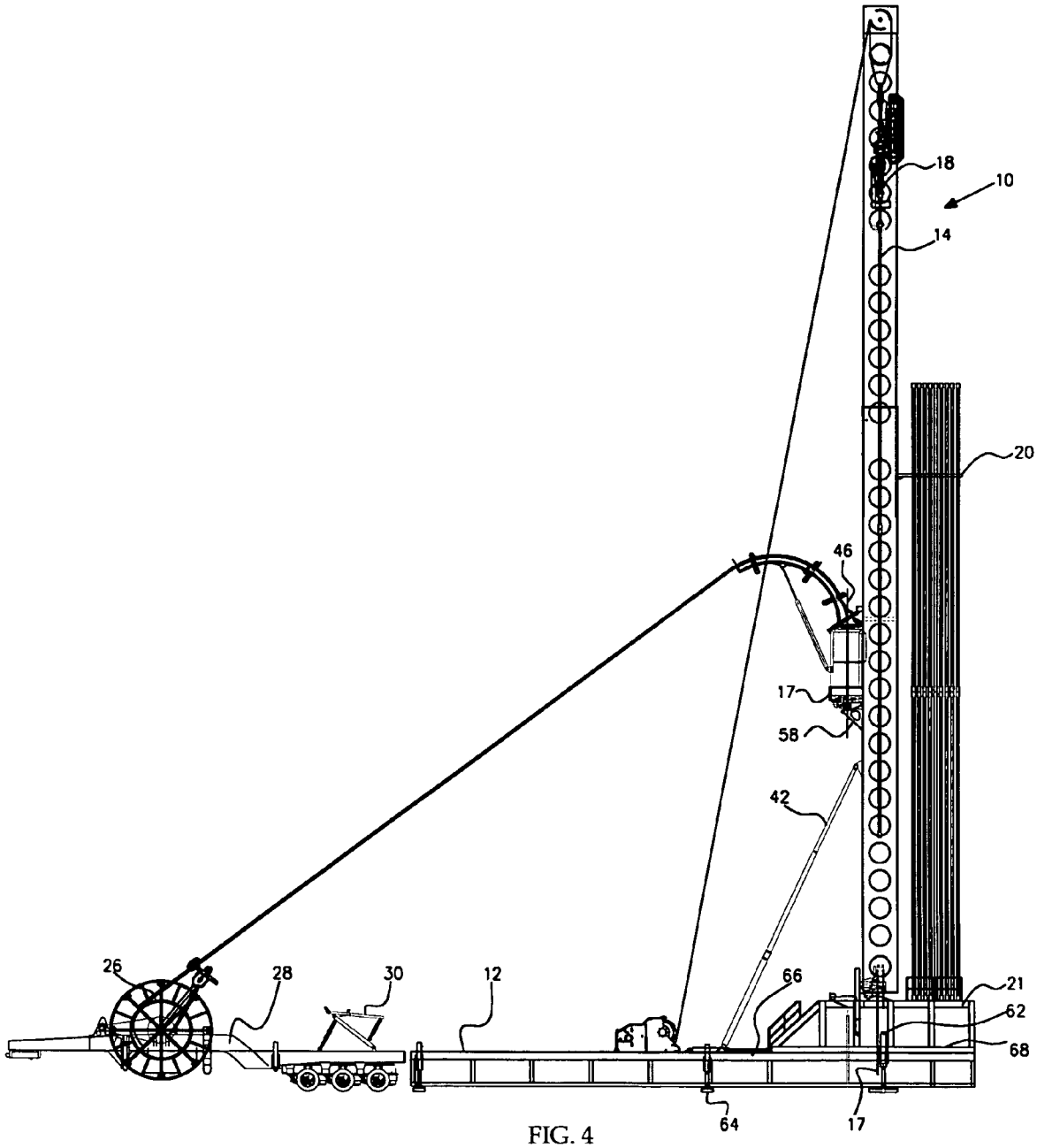
FIG. 4 discloses a rig wherein the coiled tubing injector is supported on the mast and has an injector axis spaced from an axis of the mast, with a drive unit used to move the mast with the injector, the top drive, and the support secured to the mast between a top drive position and a coiled tubing position.

FIG. 4 discloses yet another embodiment of the invention, wherein the rig includes a mast 14 which is shown aligned with the axis 17 of the well. For this and other embodiments, a plurality of outriggers 62 are depicted for leveling and stabilizing the rig base 12 when in operation. For this embodiment, the mast 14 and the tubular support 20 are movable by one or more cylinders 66 in a lateral manner, with this movement being controlled by a guide mechanism 68.

Figure 5:
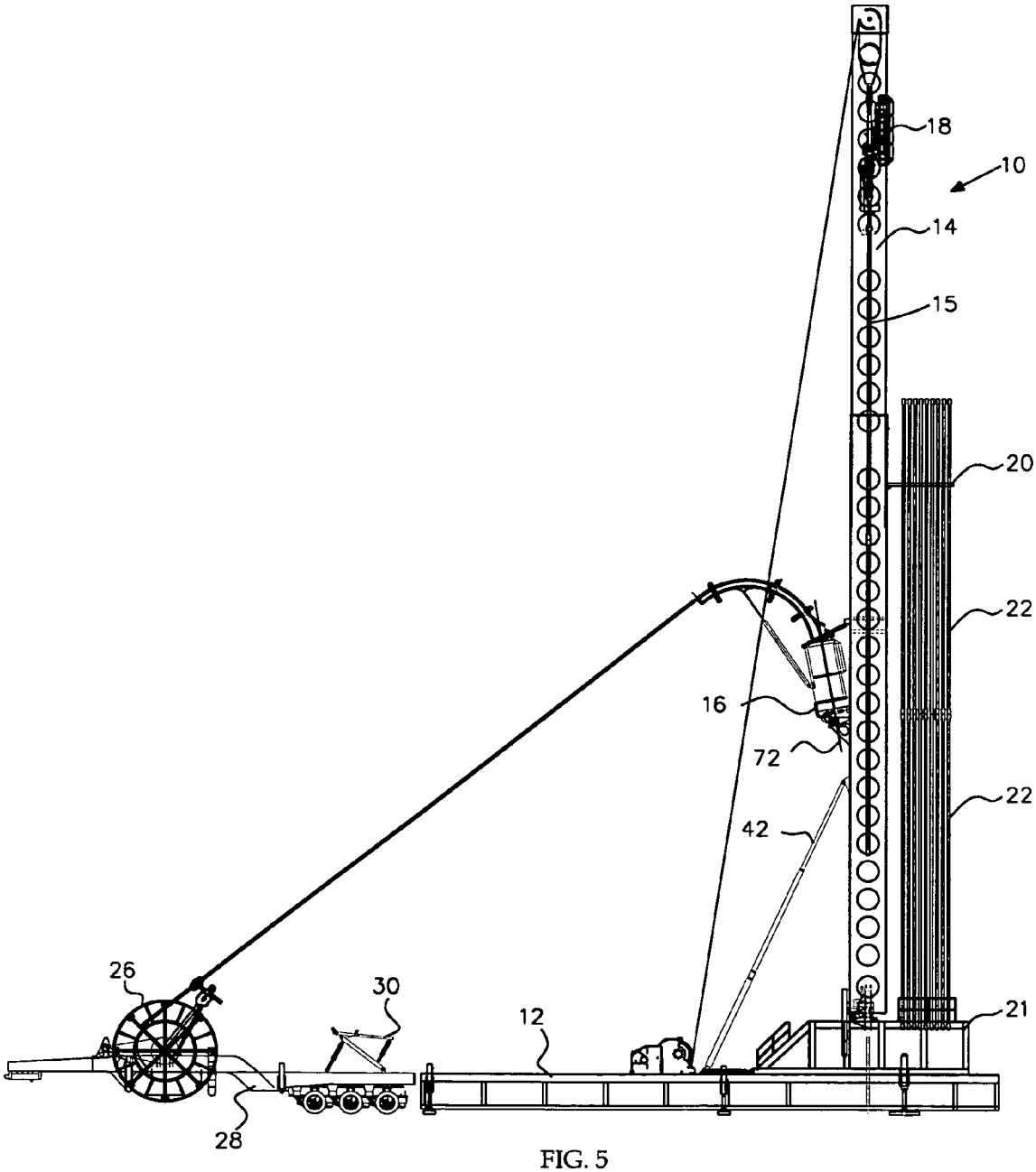
FIG. 5 discloses a rig wherein the injector is supported on the mast and has an injector axis inclined relative to the axis of the mast, such that the mast may be tilted between the top drive operative position to a coiled tubing operative position. A rack or support is secured to the mast for receiving a plurality of substantially threaded tubular joints therein.

FIG. 5 discloses an embodiment of a rig 10 with a mast 14 and a top drive 18 movable along an axis of the mast when in an operative position to insert the threaded tubulars into or out of the well. In this case, the injector 16 has an axis 72 which is inclined relative to the axis 15 of the mast, with the cylinders 42 being used to both raise the mast from a substantially horizontal position to a vertical position, and also to tilt the mast between a top drive operative position as shown in FIG. 5, wherein an axis of the top drive and the axis of the mast are aligned with the axis of the well, to a slightly inclined vertical position wherein the axis of the tubing injector 16 is aligned with the axis of the well. One disadvantage of this embodiment is that when the mast is in the coiled tubing injector operative position, the tubulars 22 are also inclined, and the weight of the inclined tubulars must be taken into consideration both with respect to adequate support for the tubulars when in the inclined position, and when moving the mast between the coiled tubing injector position and the top drive position.

Figure 6:
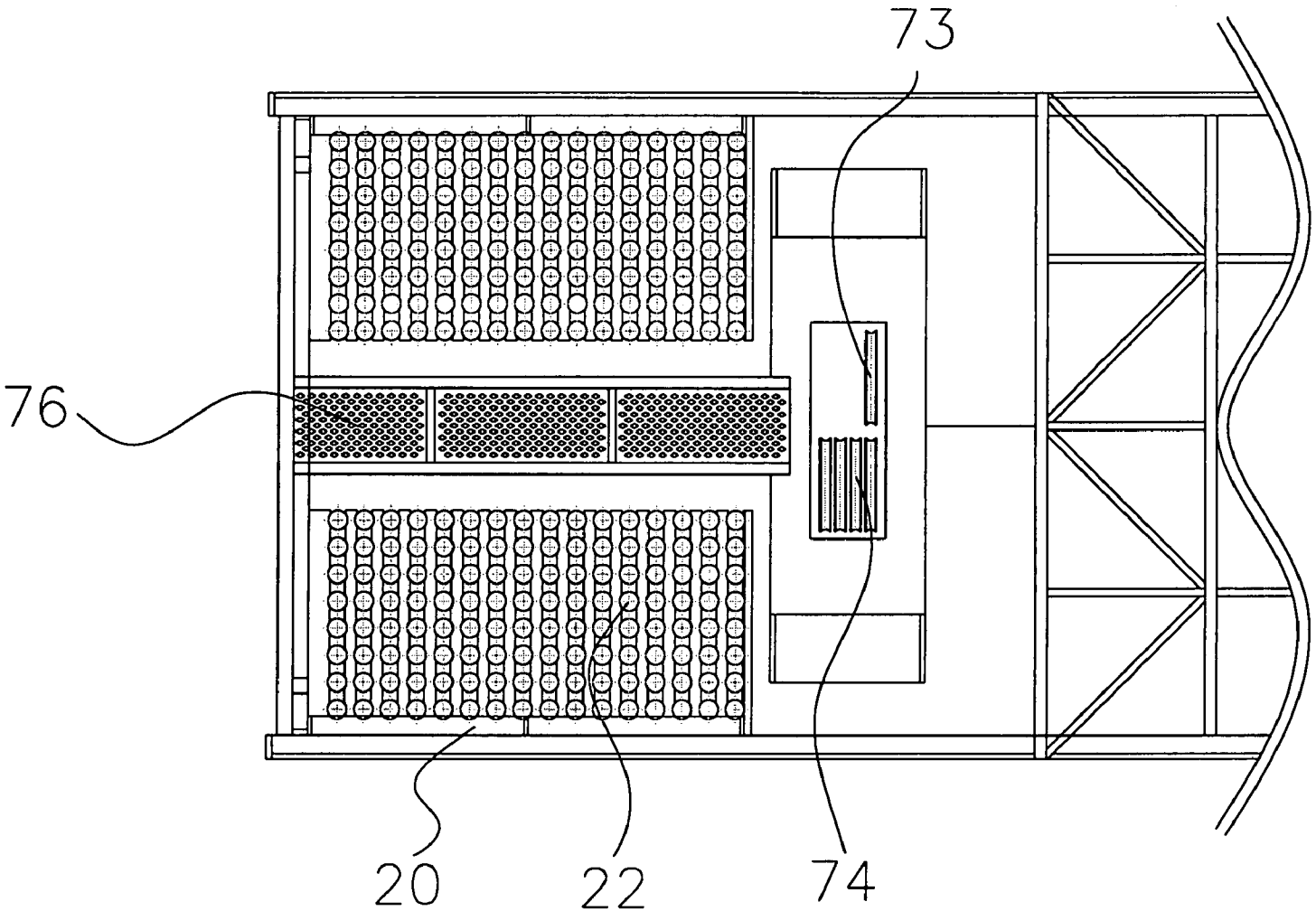
FIG. 6 is a top view of the mast and the rack or support secured to the mast.

FIG. 6 depicts a top view of a portion of the rig shown in FIG. 1, illustrating a plurality of sheaves 73, 74 for lowering lines to the injector or to other equipment on the mast. The tubular support or rack 20 is shown supporting a plurality of tubulars 22 therein, with the tubulars positioned on each side of the mast and on each side of catwalk 76 provided for the operator.

As shown in the figures, the coiled tubing reel 26 supplies coiled tubing to the coiled tubing injector 16, and is spaced opposite the tubular support 20 with respect to the mast 14 when in the operative position. The V-door is preferably provided on the side which includes the tubular support 20, and each tubular may be sequentially passed through the V-door and raised by the top drive, then threaded to a tubular already in the well, with that tubular having an upper end spaced slightly above the rig floor. A significant advantage of the present invention is obtained when tripping the tubulars into or out of the well, since each tubular need not be laid down through the V-door, and instead two or more vertically spaced tubulars may be threadably disconnected from the string, and that tubular combination placed within the rack 20. If the rack 20 accommodates two vertically spaced tubulars, only half of the connections need be made up and broken apart as compared to passing all of the individual tubulars for the V-door. Also, tubulars may be more easily placed within the rack and removed from the rack then may be individually passed through the V-door.

As previously noted, a rig as disclosed herein which utilizes both a top drive for running threaded tubulars and a coiled tubing injector for inserting coiled tubing has historically used the top drive for limited purposes, and those limited purposes have heretofore not recognized the benefit of a tubular support when running top drive operations. A rig of the type which utilizes a coiled tubing injector historically has run a substantial amount of coiled tubing into and out of the well, and relatively few threaded tubulars are run into and out of the well. The present invention recognizes, however, that relatively deep wells may be drilled to a given depth with coiled tubing, and thereafter drilled with threaded tubulars. Also, some formations may be drilled to a depth which cannot be efficiently drilled through one or more formations with coiled tubing, in which case threaded tubulars may be used to drill through those formations. Also, coiled tubing operation have difficulty in various applications when drilling directionally, and thus a well may be drilled to a desired vertical depth, then threaded tubulars used to directionally drill the well. Finally, even when using coiled tubing operations, rig time can be saved by racking drill collars or sections of a bottom hole assembly within the support 20, so that the drill collars or bottom hole assembly sections may be more quickly attached and detached from the end of the coiled tubing when run into and out of the well.

Those skilled in the art will appreciate that the stand 20 is attached to and lowered when the mast 14 is lowered to a trailered position. The embodiments as disclosed herein have illustrated a trailer for the coiled tubing reel 26 and the injector 16 which is structurally separate from the rig base and the mast 14. In other applications, these components may be provided on a single rig base. In yet other applications, a coiled tubing reel and injector may be provided on one trailer, and a rig base separate from that trailer used to support the injector and the mast 14. In still other applications, the mast 14 and injector may be lowered to yet another trailer, so that the mast is transported between rig sites separate from the rig base or substructure 12 which includes the work platform 21, and the coiled tubing reel 26 and the injector 16 are transported separate from both the mast and the rig base or substructure.

According to the method of the invention, a support is secured to the mast for receiving a plurality of substantially vertical threaded tubular joints therein when the mast is in an operative position. Coiled tubing is selectively passed through the coiled tubing injector and into the well, and the tubular joints are selectively moved between the top drive and the support when running threaded tubulars into or out of the well with the top drive. A plurality of threadably connected and vertically spaced tubular joints may be supported within the support or rack, with a coiled tubing reel spaced opposite the support with respect to the mast when in an operative position. When using the coiled tubing injector, one or more drill collars may be provided in the support when the mast is in the operative position, and the drill collars moved between the coiled tubing and the support when running coiled tubing into and out of a well. In many applications, drill pipe will be supported within the support 20, and at least a portion of the well is drilled utilizing the drill pipe from the support. Each time the threaded tubulars are tripped out of the well, the tubulars may be re-racked within the support 20, and may then be run back into the well.

Figure 7:
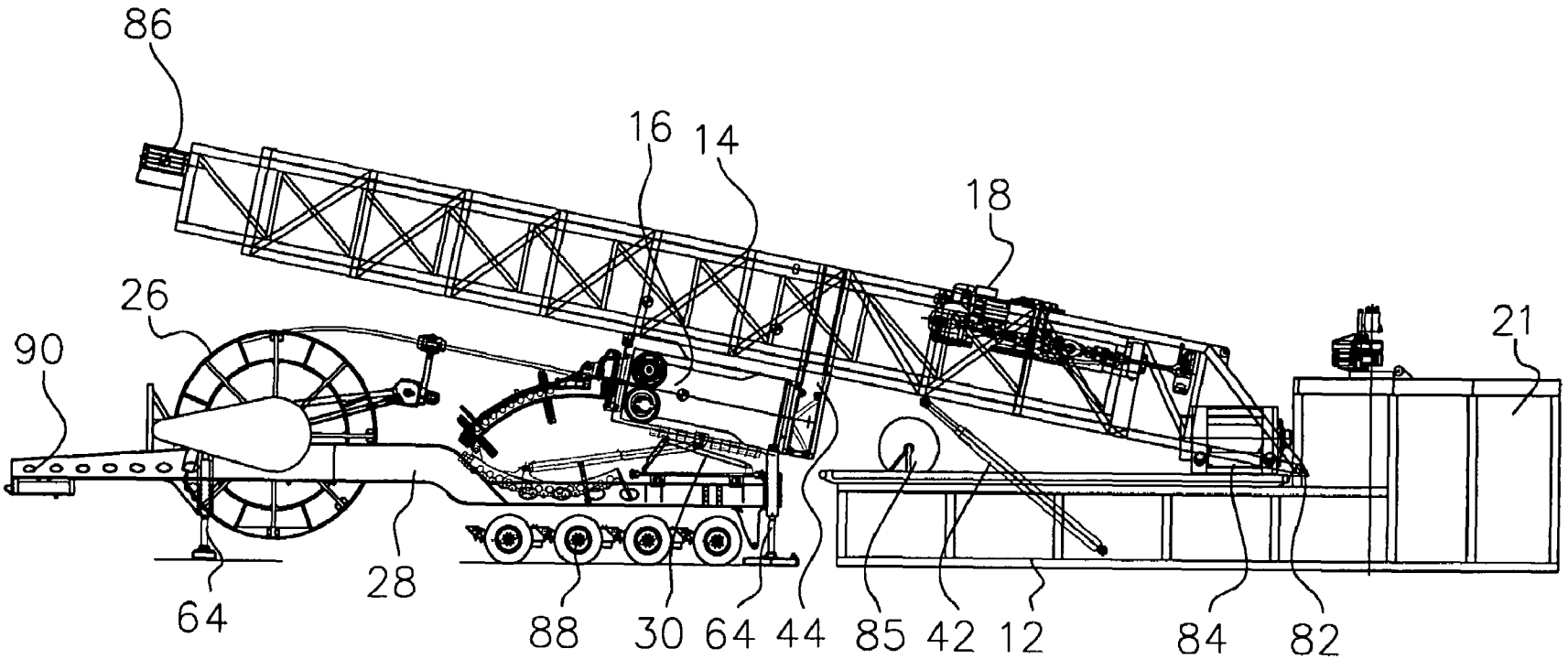
FIG. 7 discloses a mast positioned for engagement with a coiled tubing injector on a coiled tubing trailer separate from the rig base or substructure.

FIG. 7 illustrates an embodiment similar to FIG. 2, with the mast 14 pivotally connected to and supported during transit on mast carrier 80. The mast is positioned for engagement with a coiled tubing injector 16 supported on a coiled tubing carrier or trailer 28 separate from the mast carrier or trailer 12. In other embodiments, the rig base or substructure may be transported to the well site, and a separately transported mast then assembled to the base at the well site. Once assembled to the base 12, one or more cylinders 42 may thus be used from lowering the mast from a substantially upright operative position to a substantially horizontal position for travel. With both the rig base 12 and coiled tubing carrier 28 at the well site, the coiled tubing carrier may be positioned such that the mast may be raised slightly to a position over the injector 16, while the injector remains positioned on the coiled tubing carrier 28, and more specifically on platform 30. The injector 16 may then be connected with the injector 16, and the injector 16 and lubricator 32 may then be raised as a subassembly with the mast when the mast is raised to the substantially vertical operative position.

For the embodiment as shown in FIG. 7, a pair of slide members or injector supports 44 may be fixedly secured to the mast, and the injector adapted to move along the slide members in a direction generally perpendicular to the axis of the mast between an operative position wherein the injector is aligned with a centerline of the mast and an inoperative storage position wherein the centerline of the injector is spaced from the centerline of the mast. More specifically, the injector 16 may be connected to the slide members 44 while the injector is spaced from the mast. After the mast is raised to the operative position, the injector may be moved laterally to its operative position.

Those skilled in the art will appreciate that the coiled tubing reel, the coiled tubing, and injector may thus be transported as a subassembly on the same carrier 28, then the injector connected with the mast and the mast raised to the operative position, and thereafter coiled tubular operations or threaded tubing operations performed. When these operations are complete, the mast may be lowered to disengage the coiled tubing injector from the mast, and the mast and rig base may then be transported, as an assembly or separately, to another site separate from the coiled tubing carrier, coiled tubing injector, and coiled tubing reel.

Referring still to FIG. 7, those skilled in the art will appreciate that the mast carrier 12 is depicted as a skid-type unit for supporting the mast 14, which is pivotally connected to the mast carrier at pivot 82. In other embodiments, the mast carrier may include one or more axles or bogie assemblies for transporting the mast carrier to a well site. The mast carrier also includes a storage drum 85 for supplying cable to powered winch 84 for paying out or taking up a fast line or other cable to the crown block 86, and then downward (when the mast is in the operative position) to one of the traveling block or the top drive. Similarly, coiled tubing transport 28 is shown with a plurality of rear axles or bogies 88, which support the coiled tubing carrier during transport. Outriggers 64 are provided for supporting and leveling the coiled tubing carrier when at the well site. The front end of the transport 28 includes a gooseneck mechanism 90 adapted for connection to a conventional tractor of a tractor/trailer unit. The transport 28 thus houses the reel 26 for the coiled tubing, the platform 30 for raising the coiled tubing injector for engagement with the mast 14, and the injector 16 during transport. A particular feature of the invention is that the coiled tubing need not be removed from the injector 16 when transporting the rig assembly to another site, since the coiled tubing reel 26 and the injector 16 are on the same transport, more particularly on a transport structurally separate from the mast carrier 12.

Those skilled in the art will also appreciate that the mast may be lowered for connection with the coiled tubing injector while supported on a platform 30 for embodiments other than as shown in FIG. 2 wherein the injector moves between an operative position wherein a centerline of the injector is over the well and an inoperative position, wherein the centerline of the injector is spaced from the centerline of the mast. An injector which is fixed relative to the mast and the mast pivots between a coiled tubing position and a top drive position is shown in FIG. 5, and this mast may be connected to an injector while positioned on the platform 30. The mast which is laterally movable between a coiled tubing position and a top drive position as shown in FIG. 4 may similarly be connected to an injector while on the coiled tubing carrier. A coiled tubing injector which allows coiled tubing to pass through the top drive may similarly be connected to a mast when lowered relative to the mast carrier, as shown in FIG. 3. The same technique may be used to pick up an injector having a lubricator axis offset from the mast, as shown in FIG. 1.

FIGS. 1-5 disclose a pipe rack or pipe support on the mast carrier. Those skilled in the art will appreciate that the pipe stand or pipe support 22 may be fixed to the mast and lowered with the mast to pick up the injector. Alternatively, the pipe stands or pipe support may be structurally disconnected from the mast before the mast is lowered to pick up the injector. Also, those skilled in the art will appreciate that a combination of a mast carrier and a separate coiled tubing carrier as disclosed herein may be employed independent of the pipe support or pipe stand, although the combination of two carriers and the pipe stand is preferred for many applications.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A rig for selectively inserting coiled tubing or threaded tubulars through a rig floor and into a well, the rig comprising:

a mast extending upward from a rig base when in an operative position;

a coiled tubing carrier supporting a coiled tubing injector and a coiled tubing reel during transport, the coiled tubing carrier being structurally separate from the rig base;

the coiled tubing injector supported along the mast when in an operative position to insert the coiled tubing into the well;

a top drive movable along the mast when in an operative position to insert the threaded tubulars into the well; and the mast being pivotable on the rig base to attach the coiled tubing injector while supported on the coiled tubing carrier to the mast, such that the coiled tubing injector is raised to the operative position when the mast is raised.

2. The rig as defined in claim 1, wherein the coiled tubing injector is laterally movable relative to the mast between an inoperative position to an operative position.

3. The rig as defined in claim 1, wherein the coiled tubing injector is supported on the mast above the top drive, such that coiled tubing passes through the top drive and then into the well.

4. The rig as defined in claim 1, wherein the coiled tubing injector when in the operative position is spaced from a centerline of the mast, and a lubricator extends downward from the injector and directs the coiled tubing into the well.

5. The rig as defined in claim 1, wherein the mast pivots relative to the rig base from an inoperative position wherein the injector is supported on the mast and a centerline of the injector is out of line with the well and an operative position wherein the injector is supported on the mast and a centerline of the injector is aligned with the well.

6. The rig as defined in claim 1, wherein the mast is laterally movable with respect to the rig base from a position wherein the top drive is aligned with an axis of a well to a position wherein the coiled tubing injector is aligned with the axis of the well.

7. A rig as defined in claim 1, further comprising:

a support secured to the mast for receiving a plurality of substantially vertical threaded tubular joints therein when the mast is in the operative position, such that the tubular joints may be moved between the top drive and the support when running threaded tubulars into or out of the well;

the coiled tubing reel spaced opposite the support with respect to the mast when in the operative position; and the support supports a plurality of threadedly connected and vertically spaced tubular joints within the support.

8. The rig as defined in claim 7, wherein the support supports one or more drill collars therein when the mast is in the operative position, such that the one or more drill collars may be moved between the coiled tubing and the support when running coiled tubing into and out of the well.

9. The rig as defined in claim 7, wherein the support is pivotally connected to the mast, such that the support may be placed in a travel position when the mast is lowered for transport.

10. A rig for selectively inserting coiled tubing or threaded tubulars through a rig floor and into a well, the rig comprising:

a mast extending upward from a rig base when in an operative position;

a top drive movable along an axis of the mast when in an operative position to insert the threaded tubulars into the well;

a coiled tubing carrier supporting a coiled tubing injector and a coiled tubing reel during transport, the coiled tubing carrier being structurally separate from the rig base;

the coiled tubing injector supported along the mast when in an operative position to insert the coiled tubing into the well; and one or more fluid pressure cylinders for pivoting the mast relative to the rig base to attach the coiled tubing injector while supported on the coiled tubing carrier to the mast, such that the coiled tubing injector is raised to the operative position when the mast is raised.

11. The rig as defined in claim 10, wherein the coiled tubing injector is laterally movable relative to the mast between an inoperative position to an operative position.

12. The rig as defined in claim 10, wherein the coiled tubing injector is supported on the mast above the top drive, such that coiled tubing passes through the top drive and then into the well.

13. The rig as defined in claim 10, wherein the coiled tubing injector when in the operative position is spaced from a centerline of the mast, and a lubricator extends downward from the injector and directs the coiled tubing through the rig floor and into the well.

14. The rig as defined in claim 10, wherein the mast is laterally movable with respect to the mast carrier from a position wherein the top drive is aligned with an axis of a well to a position wherein the coiled tubing injector is aligned with the axis of the well.

15. A rig as defined in claim 10, further comprising:

a support secured to the mast for receiving a plurality of substantially vertical threaded tubular joints therein when the mast is in the operative position, such that the tubular joints may be moved between the top drive and the support when running threaded tubulars into or out of the well;

the coiled tubing reel supported on the coiled tubing carrier and spaced opposite the support with respect to the mast when in the operative position; and the support supports a plurality of threadedly connected and vertically spaced tubular joints within the support.

16. A method of transporting a rig and selectively inserting coiled tubing or threaded tubulars through a rig floor and into a well, the method comprising:

extending a mast upward from a rig base when in an operative position;

supporting a coiled tubing injector and a coiled tubing reel on a coiled tubing carrier during transport, the coiled tubing carrier being structurally separate from the rig base;

supporting the coiled tubing injector on the mast when in an operative position to insert the coiled tubing into the well;

moving a top drive along the mast when in an operative position to insert the threaded tubulars into the well; and pivoting the mast on the rig base to attach the coiled tubing injector while supported on the coiled tubing carrier to the mast, such that the coiled tubing injector is raised to the operative position when the mast is raised.

17. The method as defined in claim 16, wherein the coiled tubing injector is laterally movable relative to the mast between an inoperative position to an operative position.

18. The method as defined in claim 16, wherein the coiled tubing injector when in the operative position is spaced from a centerline of the mast, and a lubricator extends downward from the injector and directs the coiled tubing through the rig floor and into the well.

19. The method as defined in claim 16, wherein the mast pivots relative to the rig base from an inoperative position wherein the injector is supported on the coiled tubing carrier and an operative position wherein a centerline of the injector is aligned with the well.

20. A method as defined in claim 16, further comprising:

securing a support to the mast for receiving a plurality of substantially vertical threaded tubular joints therein when the mast is in the operative position, such that the tubular joints may be moved between the top drive and the support when running threaded tubulars into or out of the well;

positioning the coiled tubing reel opposite the support with respect to the mast when in the operative position; and supporting a plurality of threadedly connected and vertically spaced tubular joints within the support.

21. A rig for selectively inserting coiled tubing or threaded tubulars through a rig floor and into a well, the rig comprising:

a mast extending upward from a rig base when in an operative position;

a coiled tubing carrier supporting a coiled tubing injector during transport, the coiled tubing carrier being structurally separate from the rig base;

the coiled tubing injector supported along the mast when in an operative position to insert the coiled tubing into the well;

a top drive movable along an axis of the mast when in an operative position to insert the threaded tubulars into the well;

a powered winch supported on the rig base for moving the top drive along the mast; and the mast being pivotable on the rig base to attach the coiled tubing injector while supported on the coiled tubing carrier to the mast, such that the coiled tubing injector is raised to the operative position when the mast is raised.

22. A rig as defined in claim 21, further comprising:

a support secured to the mast for receiving a plurality of substantially vertical threaded tubular joints therein when the mast is in the operative position, such that the tubular joints may be moved between the top drive and the support when running threaded tubulars into or out of the well;

the coiled tubing reel spaced opposite the support with respect to the mast when in the operative position; and the support supports a plurality of threadedly connected and vertically spaced tubular joints within the support.

23. The rig as defined in claim 22, wherein the support is pivotally connected to the mast, such that the support may be placed in a travel position when the mast is lowered for transport.

* * * * *